US008870615B2

(12) United States Patent
Schulz

(10) Patent No.: US 8,870,615 B2
(45) Date of Patent: Oct. 28, 2014

(54) DYNAMIC FOOT REPOSITIONING SYSTEMS

(71) Applicant: Peter Schulz, Gearhart, OR (US)

(72) Inventor: Peter Schulz, Gearhart, OR (US)

( * ) Notice: Subject to any disclaimer, the term of this patent is extended or adjusted under 35 U.S.C. 154(b) by 80 days.

(21) Appl. No.: 13/850,098

(22) Filed: Mar. 25, 2013

(65) Prior Publication Data

US 2013/0213287 A1 Aug. 22, 2013

(51) Int. Cl.
*A63C 5/03* (2006.01)
*B63B 35/79* (2006.01)

(52) U.S. Cl.
CPC ..... *B63B 35/7953* (2013.01); *B63B 35/7936* (2013.01); *A63C 2203/54* (2013.01)
USPC ..... 441/74; 441/76; 441/78; 441/70; 114/39.12; 114/39.19

(58) Field of Classification Search
USPC ..... 441/74, 70, 76, 78; 114/39.12, 39.19
See application file for complete search history.

(56) References Cited

U.S. PATENT DOCUMENTS 4,506,905 A * 3/1985 Krob et al. ..... 280/633
4,759,734 A * 7/1988 Scheurer et al. ..... 441/70
4,954,106 A * 9/1990 Shuh-Chin ..... 440/21
5,429,538 A * 7/1995 Hwu ..... 441/77
5,553,883 A * 9/1996 Erb ..... 280/607
6,168,486 B1 * 1/2001 Lin ..... 441/76
6,213,830 B1 * 4/2001 Robinson ..... 441/65
6,237,520 B1 * 5/2001 Sisseren ..... 114/39.19
6,293,577 B1 * 9/2001 Shields ..... 280/617
6,461,210 B2 * 10/2002 Lorenzo ..... 441/68
6,558,217 B1 * 5/2003 Jones ..... 441/70
6,579,134 B1 * 6/2003 Fiebing ..... 440/21
6,863,583 B2 * 3/2005 Takahashi ..... 441/74
6,955,616 B1 * 10/2005 Barth et al. ..... 473/452
7,048,599 B1 * 5/2006 Garwood et al. ..... 440/21
7,648,404 B1 * 1/2010 Martin ..... 441/70
7,837,218 B2 * 11/2010 Flaig ..... 280/612
7,901,261 B1 * 3/2011 Rosas Zarich et al. ..... 441/74
8,132,818 B2 * 3/2012 Cunningham et al. ..... 280/14.24
2001/0053642 A1 * 12/2001 Chao ..... 441/76
2012/0227651 A1 * 9/2012 Kuntzel ..... 114/39.19
2013/0102211 A1 * 4/2013 Ruiz ..... 441/74
2013/0213287 A1 * 8/2013 Schulz ..... 114/39.12

* cited by examiner

*Primary Examiner* — Lars A Olson
*Assistant Examiner* — Jovon Hayes
(74) *Attorney, Agent, or Firm* — Mohr Intellectual Property Law Solutions, PC

(57) ABSTRACT

Dynamic foot repositioning systems for a gliding board including a platform, having a top surface and a bottom surface, the platform including a foot receptacle disposed on the top surface of the platform, and a tether coupled to the platform with a distal end protruding from the bottom surface of the platform. The systems further include a guide track configured to slidably receive the distal end of the tether, the guide track defining a motion path over which the platform slides freely in response to forces applied by a user's foot while the gliding board is traversing a supporting surface. Related gliding board assemblies and methods for repositioning a user's feet are also described.

20 Claims, 12 Drawing Sheets

DYNAMIC FOOT REPOSITIONING SYSTEMS

BACKGROUND

The present disclosure relates generally to foot repositioning systems for gliding boards, as well as related gliding board assemblies and methods of use. In particular, foot repositioning systems with dynamic mobility features that allow a rider to move his feet freely along a gliding board while maintaining control over the gliding board are described.

Known foot attachments and repositioning systems are not entirely satisfactory for the range of applications in which they are employed. For example, existing foot attachment systems, such as used on sail boards for windsurfers, typically include foot straps that the feet are placed into during planing of the board. The foot straps allow secure attachment of the rider's feet to the board. Conventional foot straps are generally fixed to the board and are typically non-adjustable during use. There are some foot attachment systems that include a mechanism allowing tensioning of the strap while the user is on the board. Other known assemblies may have a rotatable foot strap plate which allow the user to pivot a foot strap at a particular location during use.

For the rider to change direction while the board is planing, a complex maneuver must be accomplished. For example, to reorient the sail, or kite board, to the other side relative to the wind the rider must remove the feet from both foot straps on one side of the board and reinsert them into foot straps on the other side. This maneuver is known as jibing and involves numerous actions of different parts of the body and equipment and typically takes years to learn. In some instances, performing a successful jibe can be achieved by reducing speed or by the board coming off a plane. However, these techniques are less fun for the rider and may prevent the sailor from achieving other goals such as catching or riding a wave or swell, keeping up with or passing other sailors, staying with an increased area of wind, etc. When a sailor fails to execute a jibe, the sailor may fall in the water, which is frustrating, tiring, and poses risk of injury or damage to equipment.

Thus, there exists a need for foot repositioning systems, gliding board assemblies, and foot repositioning methods that improve upon and advance the design of known techniques. Examples of new and useful systems, assemblies, and methods relevant to the needs existing in the field are discussed below.

Disclosure addressing one or more of the identified existing needs is provided in the detailed description below. Examples of references relevant to foot attachment systems include U.S. Pat. Nos. 5,893,785, 5,045,006, and 7,901,261 and U.S. Patent Application Publications 2012/0227651 and 2005/0087115. The complete disclosures of the above patents and patent applications are herein incorporated by reference for all purposes.

SUMMARY

The present disclosure is directed to a foot repositioning system for a gliding board, including a platform having a top surface and a bottom surface, the platform including a foot receptacle disposed on the top surface of the platform, and a tether coupled to the platform with a distal end protruding from the bottom surface of the platform. The system further includes a guide track configured to slidably receive the distal end of the tether, the guide track defining a motion path over which the platform slides freely in response to forces applied by a user's foot while the board is traversing a supporting surface.

In some examples, the distal end of the tether and the guide track are configured to prevent the platform from being released from the guide track while the gliding board is traversing a supporting surface. In some further examples, the tether may include a tensioning element, such as a spring element, tensioning the distal end of the tether to a portion of the guide track until the user applies a counteracting force to the platform. In some possible embodiments, the system may further include a mounting plate configured to be coupled to the gliding board and the guide track may be formed in the mounting plate.

In some examples, the mounting plate may include one or more fastening elements allowing coupling of the mounting plate to pre-existing features of the gliding board. In other examples, the mounting plate may include a slot configured to guide the distal end of the tether along the motion path. In further possible embodiments, the mounting plate may include a spacing element configured to be sandwiched between the mounting plate and the gliding board and dimensioned to allow free movement of the platform along the motion path. In some examples, the mounting plate comprises a friction surface providing friction to the bottom surface of the platform thereby restricting sliding movement of the platform along the guide track.

In further examples, the mounting plate may include one or more parking zones allowing the user to secure the platform in a predetermined position and to release the platform from the predetermined position by applying a counteracting force to the platform while the gliding board is traversing a supporting surface. In further possible embodiments, the system may include a restraining element coupled to the platform and configured to interact with a complementary element of the gliding board to assist in holding the platform in place in the parking zone. In another possible embodiment, the guide track and the tether may be dimensioned to provide an interference fit in the parking zone.

The inventive subject matter is further directed to a gliding board assembly including a gliding board for traversing a supporting surface while a user is riding the board, a platform having a top surface and a bottom surface, the platform including a foot receptacle disposed on the top surface of the platform and a tether coupled to the platform with a distal end protruding from the bottom surface of the platform. The assembly further includes a guide track disposed on the gliding board and the guide track having an opening configured to slidably receive the distal end of the tether, the guide track defining a motion path over which the platform slides freely in response to forces applied by a user's foot while the gliding board is traversing a supporting surface. In some examples, the guide track may be an integrated part of the gliding board.

In other examples, the gliding board may have a friction surface providing friction to the bottom surface of the platform thereby restricting sliding movement of the platform along the guide track. In some embodiments, the bottom surface of the platform may include a friction surface restricting sliding movement of the platform along the guide track upon application of force to the platform by a user. In further embodiments, the gliding board may have a bow at one end and a stern at the other end of the gliding board, and the guide track may be located closer to the stern than to the bow.

The inventive subject matter further contemplates a method for repositioning a user's feet on a gliding board by positioning the feet in foot receptacles on platform, moving the feet toward a desired position along a predetermined guide track by applying force with a foot to the platform allowing the platform to slide freely along the guide track until the desired position is reached, holding the feet in the desired position by applying a tensioning force to the platform and the guide track, repositioning the feet along the guide track by releasing tension to the platform and the guide track, and repositioning the platform to a different desired position along the guide track. In some embodiments, the guide track may be integrated with the gliding board. In other embodiments, the guide track may be provided on a mounting plate configured to be coupled to the gliding board.

DETAILED DESCRIPTION

Figure 1:
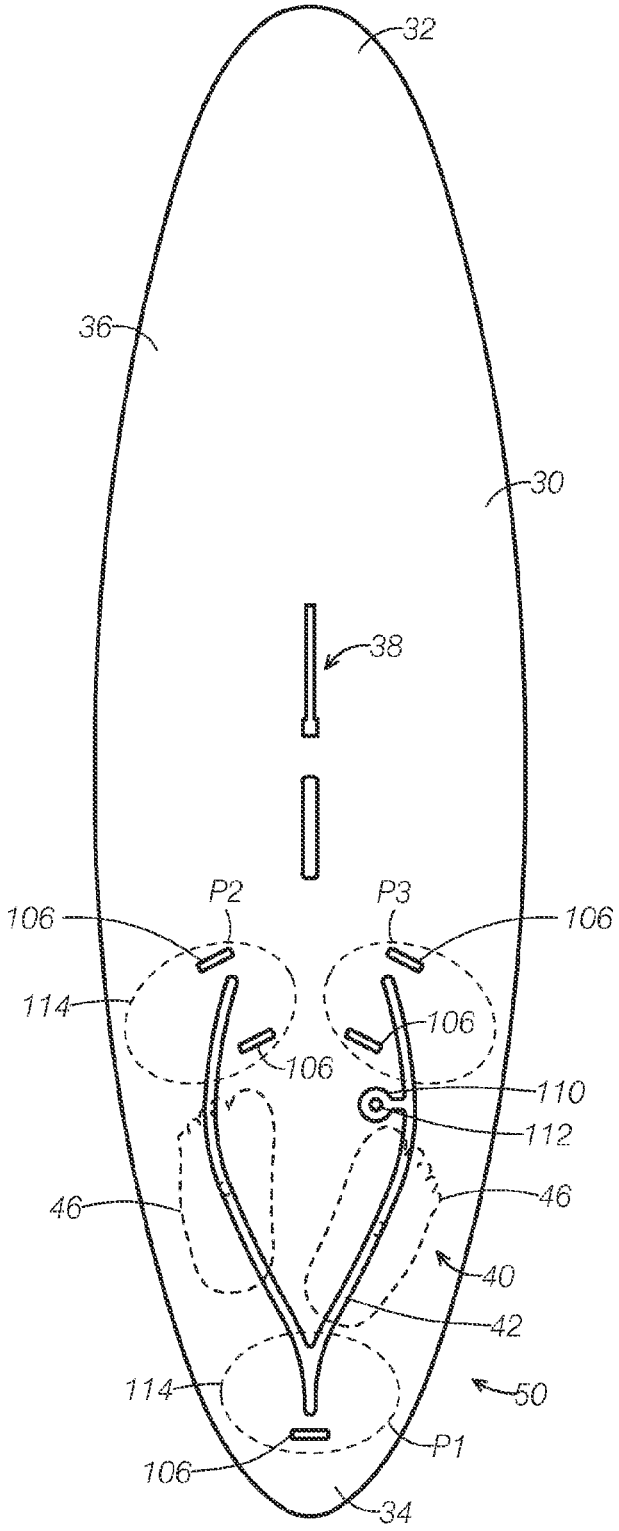
FIG. 1 is a top view of a gliding board having a guide track according to a first embodiment.

The disclosed dynamic foot repositioning systems, related assemblies, and methods will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplate variation is not individually described in the following detailed description.

Throughout the following detailed description, examples of various systems, assemblies, and methods of use are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

As used herein the term "gliding board" refers to a board which is used in sports where a user stands on a board and the board "glides" over some form of "supporting surface." For example, a surf board is a gliding board where the user stands on the surfboard and the surfboard "glides" over the water surface. Another example is a skateboard where the user stands on the board and the skateboard "glides" over an asphalt surface. Another example is a snowboard where the supporting surface is snow. In some applications a gliding board may have uni-directional use, while other applications and boards may allow bi-directional use. Although dynamic foot repositioning systems, assemblies, and methods described herein related to "gliding boards" on water, the inventive subject matter may be readily adapted for use in other applications.

The terms "user," "rider," and "sailor" are used interchangeably herein to refer to a person riding the gliding board.

FIGS. 1-11 show a first embodiment of a foot repositioning system 40 and a gliding board assembly 50 as it is applied to a windsurf board 30. Windsurf board 30 has a bow 32 and a stern 34, and an upper surface 36 supporting a rider when using the windsurf board. Windsurf board 30 further has a mast track 38 exposed in upper surface 36 allowing coupling of the board to a mast base. Foot repositioning system 40 may include a platform 46 and a guide track 42.

Two platforms are typically disposed on the guide track, for example as shown in FIG. 1. In some embodiments, one platform may be configured to receive a right foot and another platform may be configured to receive a left foot. However, in some embodiments only one platform may be used to slidably engage the guide track and a second foot receptacle may be positioned at a rotatable fixed location.

Guide track 42 defines a motion path over which a rider can reposition his foot by performing a sliding motion while the foot is disposed in foot receptacle 48. Platform 46 remains connected to guide track 42 throughout the maneuver, for example throughout the jibing process. The repositioning system allows a rider to reposition his foot, or both feet, when executing the maneuver, even in challenging conditions and at high speed. For example, the system allows a rider to move his feet to a variety of locations and orientations on the board while planing and without removing his feet from the foot receptacle.

In the embodiment shown in FIGS. 1-11, guide track 42 is integrated in an upper surface 36 of windsurf board 30. Guide track 42 is constructed as a channel 44 with a slot 86 positioned at upper surface 36 of windsurf board 30. As shown in FIG. 1, guide track 42 may follow a path extending mainly along the length of windsurf board 30, for example a path having the shape of a wishbone, as seen in a top view of windsurf board 30, with the open ends of the wishbone shape facing bow 32 and closed end of the wishbone shape facing stern 34. However, in other embodiments, the guide track may follow a different path for example as further discussed below with reference to FIGS. 22, 23, and 25.

Examples of suitable materials used for making a guide track include wood covered with fiberglass, plastic such as used to construct mast and fin boxes, metal, or other materials that are sufficiently durable to withstand force and wear and that are compatible with board construction.

Figure 4:
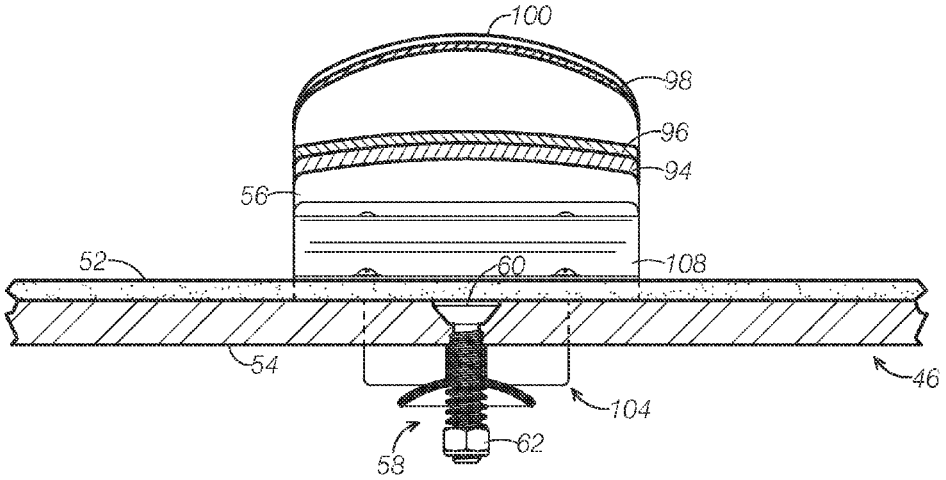
FIG. 4 is a cross-sectional view, along line 4-4 of the platform shown in FIG. 3
Figure 5:
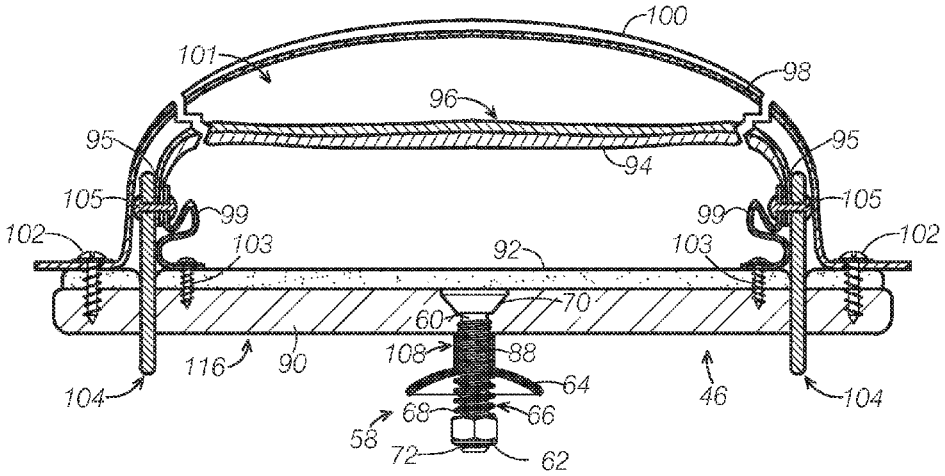
FIG. 5 is a cross-sectional vie along line 5-5 of the platform shown in FIG. 2.
Figure 7:
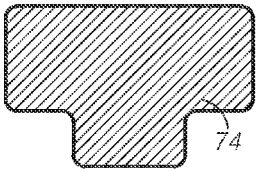
FIG. 7 is a cross-sectional view along line 7-7 of the guide track of FIG. 6.
Figure 8:
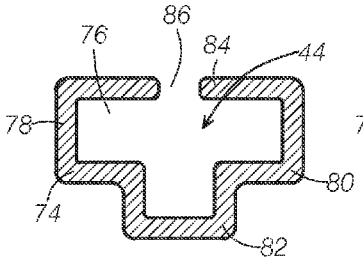
FIG. 8 is a cross-sectional view along line 8-8 of the guide track of FIG. 6.
Figure 9:
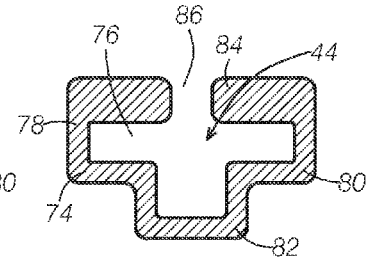
FIG. 9 is a cross-sectional view along line 9-9 of the guide track of FIG. 6.
Figure 6:
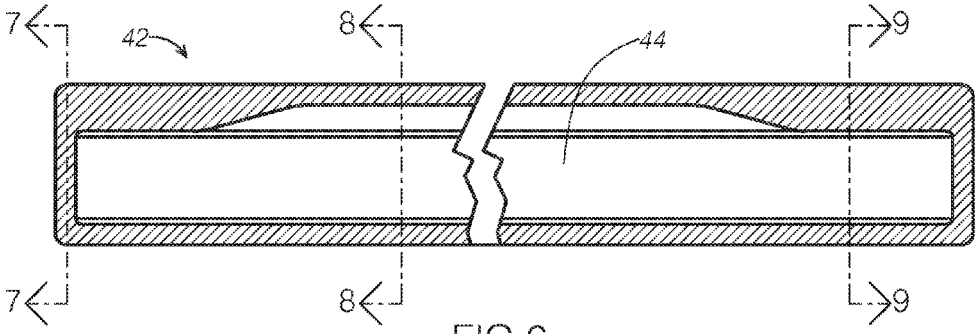
FIG. 6 is a simplified cross-sectional view along a length of the guide track of FIG. 1

Foot repositioning system 40 further includes a platform 46. Platform 46 has a top surface 52 and a bottom surface 54, as shown in FIGS. 4 and 5. FIG. 5 shows a platform including a generally rigid support surface 90 that is large enough to place the foot upon. A foot bed surface 92, including a relatively soft and resilient material, may be provided on top of support surface 90 for comfort and grip.

In the embodiment shown in FIGS. 1-11, it is assumed that the upper surface 36 of windsurf board 36 has a relatively flat surface in the areas where the platform travels. In embodiments wherein the gliding board has a slightly curved upper surface, platforms may be shaped to complement the upper surface, for example including a concave shaped bottom surface of a platform to match a convex shaped upper surface of the gliding board surface. In other embodiments, a platform may be made of a semi-rigid material allowing the platform to conform to the upper surface of the gliding board when the rider's weight is applied to the platform.

Figure 2:
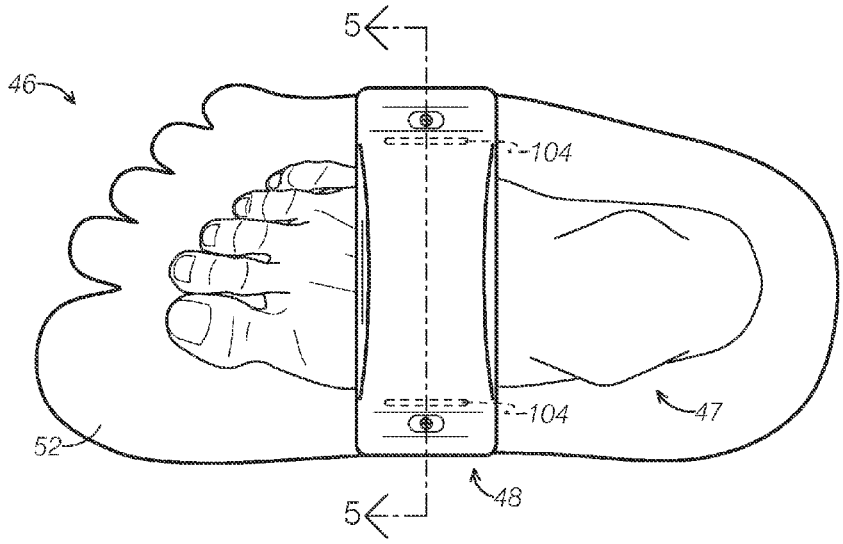
FIG. 2 is a top view of a platform suitable for use with the guide track shown in FIG. 1.

In some embodiments, platform 46 may have a distinctive shape depending on whether the platform will accommodate a right foot or a left foot. An example of a platform 46 adapted to receive a right foot 47 is shown in FIG. 2. Other embodiments may include systems having asymmetrical shapes or indicia allowing users to distinguish easily between platforms fitted for receiving a left foot and platforms fitted for receiving a right foot.

In some embodiments, platform 46 may measure about 12 inches by about 7 inches with a recess for a foot in the upper surface of about ⅛ inch to about 3⁄16 inch. A cushioning foot pad of about 7⁄16 inch may be provided to such a platform.

Platform 46 further includes a foot receptacle 48, for example in the form of adjustable foot strap 56 coupled to platform 46, as shown in FIG. 5. Foot strap 56 may have a layered structure to provide a comfortable and adjustable foot strap. For example, foot strap 56 has an inner layer 94 that faces the foot, a middle layer 96, and an outer layer 98 with a cover 100.

A gap 101 may exist below outer layer 98 for allowing adjustment of foot strap 56. Inner layer 94 may include a cushioning material for comfort. Outer layer 98 may include an elastic material that is attached at each side of the strap, for example a stretchable fabric attached to the platform via a removable screw 102.

Middle layer 96 may include a non-elastic material. Middle layer 96 may further include a restraining element 104 that is retracted when the foot is inserted in foot receptacle 48. Cover 100 may wrap and cover foot strap 56 for aesthetic appeal, protection from the elements, and keeping layers oriented properly.

Other embodiments may have different adjustment and tensioning mechanisms, for example as provided with a cinch buckle. In some embodiments, an inner strap or tab may be attached to a spring that provides a downward force to the foot strap. An example of a suitable foot strap is described in U.S. Pat. No. 5,893,785, which is hereby incorporated by reference in its entirety. In other embodiments, foot receptacles may include shoes, socks, and/or bindings or other suitable foot retention structures. Generally, a suitable strap must be secure enough to withstand waves, spray, wind, unintended contact, etc. and adjustable to allow for different foot sizes, wearing of foot coverings, and/or adjusting for wear of the strap.

FIG. 5 shows a restraining element 104, for example a locking tab, extending through platform 46 and coupled to foot strap 56. Restraining element 104 protrudes from platform 46 when the platform is not in use and engages an opening in upper surface 36 of windsurf board 30. For example, outer layer 98, coupled to platform 46 with adjustment screws 102, may tension and bias restraining element 104 to extend from platform 46, When a foot is secured in foot receptacle 48, restraining element 104 may be pulled back via force of the foot on middle layer 96 and release the platform from upper surface 36 of windsurf board 30.

In some embodiments, foot receptacle 48 may include distinct lateral and medial sides corresponding to the shape of a foot. For example, a foot receptacle may have a foot strap with an inner layer extending higher above the platform on the medial side of the foot than on the lateral side of the foot providing a tailored fit to the foot and assist the user with applying force when retracting restraining elements 104 from slots 106.

Optionally, some embodiments may include a constraining element 99 coupled to one or more layers of adjustable foot strap 56. For example, a nylon webbing may be sewn to a layer of foot strap 56, for example at location 95 shown in FIG. 5. Constraining element 99 may be coupled to platform 46 with a fastener, for example a screw 103, and coupled to restraining element 104, for example with a rivet 105.

Constraining element 99 and restraining element 104 are dimensioned and arranged to prevent restraining element 104 from being detached from platform 46. In particular, constraining element 99 prevents restraining element 104 from rising above foot bed surface 92 and keeps restraining element 104 properly oriented.

In some embodiments, constraining element 99 may include two or more openings at a foot strap side, for example to receive rivets 105, that are in line with the slope of the corresponding foot, for example openings positioned consecutively lower towards the front of the foot.

Figure 3:
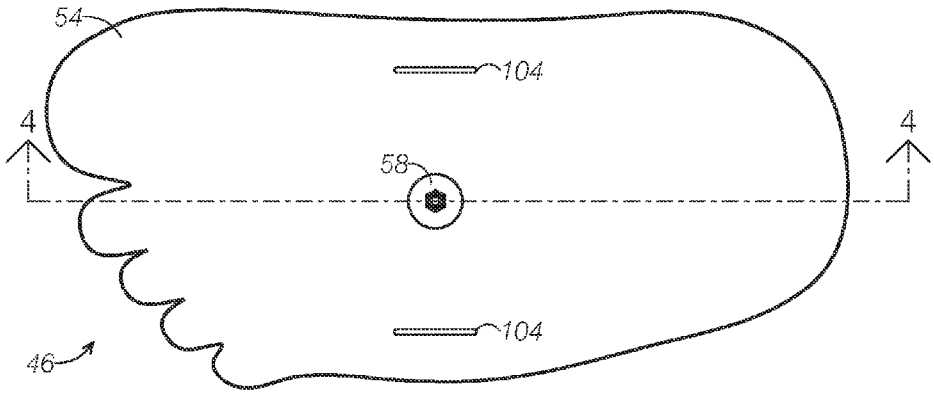
FIG. 3 is a bottom view of the platform shown FIG. 2.

Platform 46 further includes a tether 58 coupling platform 46 to guide track 42 so that platform 46 interacts with guide track 42 and allows platform 46 to move freely in a longitudinal direction along the track. In the embodiment shown in FIGS. 1-11, distal end 62 of tether 58 extends from bottom surface 54 of platform 46 so that the pivot point of platform 46 is just to the rear of the center of platform 46 thereby assisting in stability of the platform under load and minimizing twisting forces, as shown in FIG. 3.

However, in other embodiments, the distal end of a tether may extend at any other suitable location allowing interaction with a complementary guide track. Further embodiments may include more than one tether, for example a first rotating platform tethered to a second platform that in turn is tethered to a guide track to allow repositioning of the feet along the guide track. In other examples, the repositioning system may include a platform wrapped around a guide track.

Tether 58 may have a coupling end 60 that is secured to platform 46, for example via conventional fasteners, such as bolt 70, or other known fastening and/or joining techniques. Optionally, additional fasteners may be used to secure the tether to the platform. In other embodiments, tether and platform may form an integrated unit interacting with a guide track.

Figure 10:
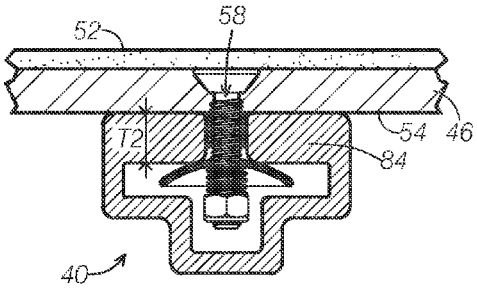
FIG. 10 is a cross-sectional view showing a portion of the platform and the guide track with the platform in a parked position.
Figure 11:
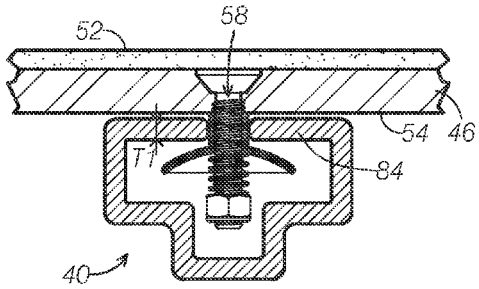
FIG. 11 is a cross-sectional view showing a portion of the platform and the guide track with the platform in a traveling position.
Figure 14:
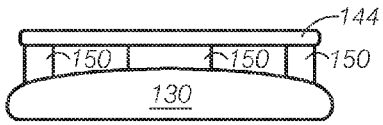
FIG. 14 is a cross-sectional view taken along line 14-14 of FIG. 12.

Tether 58 further includes a distal end 62 protruding from bottom surface 54 of platform 46, as shown in FIGS. 5, 10, and 11. Distal end 62 may include a tensioning mechanism 66 that provides ad impeding force on a portion of guide tack 42. Tether 58 may include conventional hardware components, including for example a metal bolt.

Tensioning mechanism 66 may interact with features of the guide track providing the rider the option of allowing the platform to slide along the guide track or lock the platform in a desired position, for example in a parking zone. FIGS. 10 and 11 show an example of a tensioning mechanism 66 at distal end 62 of tether 58 wherein tensioning mechanism 66 includes a force distribution element 64, such as a curved disc or a curved washer, a tensioning element 68, such as a spring element, and a lock nut 72 securing tensioning element 68 at the distal end 62. A protective sleeve 108 may surround a stem portion 88 of tether 58 to minimize wear on guide track 42.

FIG. 11 illustrates a traveling position of platform 46 where tensioning mechanism 66 is in a relaxed position and distal end 62 of tether 58 moves freely in a longitudinal direction of channel 44 while force distribution element 64 of tether 58 prevents substantial movement of the platform in a direction transverse to guide track 42. FIG. 10 illustrates foot repositioning system 40 in a parked position whereby platform 46 is locked in a predefined position along guide track 42.

Channel 44 is formed by a channel body 74 extending along the length of the board. Channel body 74 has a generally "T" shaped cross-sectional opening 76 for receiving tether 58. Channel body 74 includes side walls 78 and 80, a bottom portion 82, and a top portion 84. Top portion 84 has a slot 86 with a width dimensioned to accommodate a stem portion 88 of tether 58. The length and width of slot 86 are dimensioned to allow stern portion 88 to move freely along guide track 42. Channel body 47 may extends beyond the lengthwise ends of slot 86 to accommodate tether hardware in parking zones, for example to allow room for force distribution element 64 extending beyond the ends of slot 86 so that platform 46 is stopped by contact of sleeve 108 with the end of slot 86, and to prevent damage to guide track or platform hardware.

Optionally, the foot repositioning system may include features making the gliding board watertight. For example, guide track 42 may include watertight seams and joints preventing water from entering the gliding board structure wherein the guide track is encased in. In other embodiment, a guide track may be formed as a one-piece structure integrated with a gliding board in a watertight manner as known in the art.

As shown in FIG. 1, windsurf board 30 may include parking zones P1, P2, P3 where platform 46 may be secured for a period of time. The use of parking zones may enhance control over the board by the user, for example parking zones may include features such as increased friction and/or a recessing of a surface, engagement of a pressure or tensioning mechanism, such as a spring, and/or recessing of the board surface. The parking zones may also provide a braking system and reduce shock and wear.

In the embodiment shown in FIGS. 1-11, a parking zone includes locking slots 106 interacting with restraining elements 104 on platform 46, a tensioning mechanism 66, and a friction surface 114. In other embodiments, other configurations that assist in holding the platform at a particular location or orientation are envisioned. Additionally, the location and number of parking zones may vary, depending on the board and its use.

FIGS. 6-11 illustrate that at predefined locations along guide track 42, the thickness of top portion 84 may increase. In a traveling position, as shown in FIG. 11, top portion 84 of guide track 42 has a thickness T1. In a parked position, shown in FIG. 10, top portion 84 has a thickness T2, which is larger than thickness T1.

In the parked position, force distribution element 64 abuts top portion 84 of channel body 86. Tensioning element 68 provides a counteracting force holding platform 46 in place when no force is applied by the rider. The tensioning forces holding the platform in place may be overcome by a user when the user slides the platform sideways away from the parking zone into a travel area of guide track 42.

Additionally, when no foot is in place on platform 46, tensioning features of foot strap 56 such as outer layer 98, may push one or more restraining elements 104 down below bottom surface 54 of platform 46. Consequently, restraining element 104 may engage a complementary element, such as a cavity or a locking slot 106 in upper surface 36 of windsurf board 30 at desired locations to secure platform 46 in a parking zone when not in use and positions platform 46 so it is ready to use. When a foot is inserted onto platform 46 and into foot strap 56, restraining element 104 retracts into platform 46 and platform 46 becomes free to move upon application of force by a user.

In some embodiments, restraining element 104 may be a solid protrusion extending from the bottom surface of the platform tensioned outward with a bias element attached to a layer of the foot strap. Other embodiments, may use features known in the art to secure the platform temporarily to the board.

In some embodiments, parking zones may include zones of increased friction, for example the board upper surface may have a friction surface 114 that inhibits sliding of the platform, such as nonskid pads positioned in the area where the platforms can travel, whereas the rest of the guide track is free of pads or obstructions. In other embodiments, platform 46 may include a friction surface 116, for example as shown in FIG. 5. Increased friction in parking zones may also be accomplished by many different materials and methods, such as adding a frictional material, for example acrylic dust to surface layer of fiberglass, epoxy, or other suitable materials.

Some embodiments may have one or more slightly indented areas that are shaped to complement the platform shape so that the platform nestles into the indented area, adding stability and resistance to rotation or movement of the platform in parking places. In further possible embodiments the guide track may include bumpers at ends of slots to reduce impact on the platform and rider when quickly moving into those positions.

Additional parking features may be provided by suitable structural features or material properties that allow the user to lock or park the platform in a desired position on the gliding board. In other embodiments, the configuration, shape, and number of parking zones may vary and parking zones may be provided in different locations, for example, depending on user preferences or application in which the gliding board is used.

Optionally some embodiments may have features allowing for removal of the platform from the guide track, features preventing unintended removal, and/or mechanisms that prevent theft of the platform. For example, guide track 42 shown in FIG. 1 includes a port 110 as part of guide track 42. Port 110 allows insertion or removal of platform 46.

A plug 112 may prevent inadvertent dislodging of the platform from the guide track should the rider fall and the platforms slide about in a situation such as being tumbled in surf. Plug 112 may include a locking feature that would prevent platform theft if the board left on the shore unattended. In sonic embodiments, plug 112 may be removable by hand, for example by using a recessed thumbscrew. In further embodiments, locking mechanisms for the platforms may be provided as separate plugs or may be made part of the guide track. Platforms that are easily removable/reinsertable provide ease of packing, for example packing the board into board bags or vehicles without interference of foot straps.

In the embodiment shown in FIGS. 1-11, the repositioning system may be used inserting two platforms into the wishbone-shaped guide track. The locking plug is subsequently re-inserted. One platform is placed into position A and the other platform is placed in position B or C. In other embodiments, there may be more starting positions, for example if one wanted to start windsurfing in a high wind situation.

In another embodiment, a board may have multiple tracks or a differently shaped track, depending on which direction the rider wants to go. Once the platforms are in place, the user achieves a standing position on the board and typically waits until planing and then inserts one foot partially into a platform strap and then the other foot into the other. Both feet are then inserted further until the platforms are released from the locking slots by the retraction of the locking tabs. This can be done upon initial insertion, if the rider is experienced with the system.

If the platform is in a parked location, the platform will not move as easily as elsewhere but rotates upon the rider's action. If the rider falls, the platforms rotate to allow the rider's feet to exit without injury in most cases, unlike fixed foot straps. If the rider wishes a different stance, one or both feet are moved along the track by the rider and the platform moves generally parallel to an upper surface of the gliding board.

A complex maneuver, such as a jibe in windsurfing, may be accomplished by lifting both feet simultaneously and "jumping" to the other stance, which is almost impossible with regular foot straps. A windsurfing rider can move easily to a sub-planing stance by parking a front platform, remove the foot, and allowing the locking tabs to re-engage the locking slots. The park positions are oriented so that moving the foot backwards from the platform causes pressure against the track by the tether, allowing the foot to be withdrawn.

The rear foot can be left in the platform if planing is anticipated again soon. The rear platform can be moved forward to a more comfortable stance position with the foot still in place. The rider may end use of the system by simply "parking" the remaining platform.

FIGS. 12-20 illustrate a second embodiment of the inventive subject matter wherein a foot repositioning system 140 is configured as a retrofit system for an existing gliding board, for example a windsurf board 130. A guide track 142 may be presented on a mounting plate 144 that is adapted to be mounted on an existing gliding board 130. Platforms 162 and 164 may be used with mounting plate 144. In some embodiments, platforms 162 and 164 may have features similar or identical to platform 46, described in the first embodiment above. A detailed description of those features is omitted here for the sake of brevity. The reader should reference the discussion above for example features of platforms 162 and 164.

Figure 13:
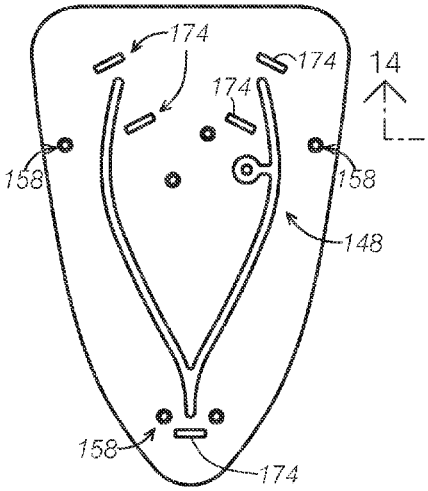
FIG. 13 is a top view of the mounting plate of FIG. 12 shown with a guide track.
Figure 12:
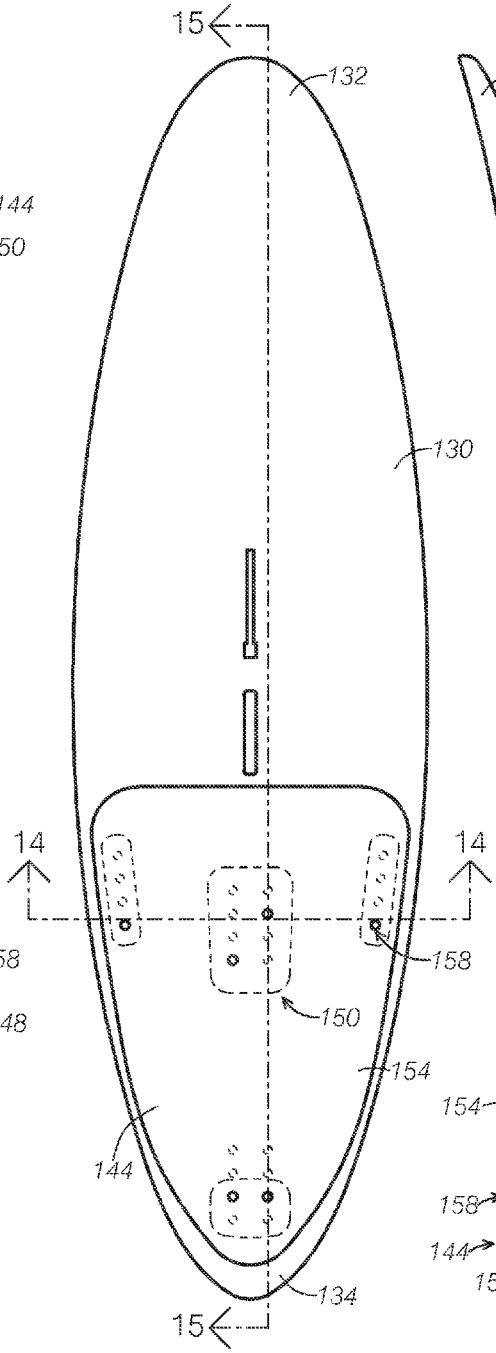
FIG. 12 is a simplified top view of an existing gliding board provided with a mounting plate shown without a guide track.
Figure 15:
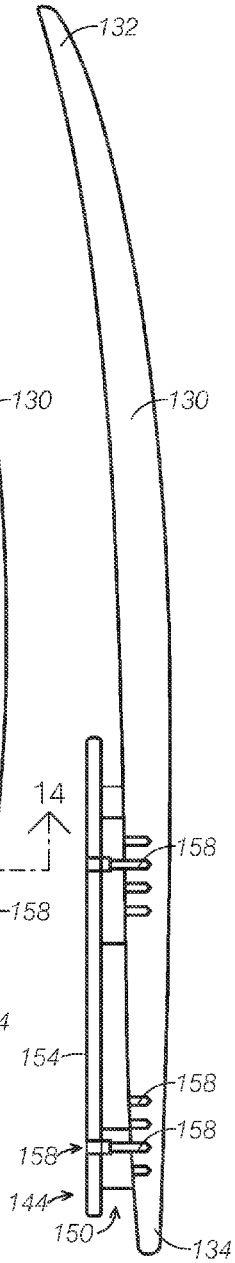
FIG. 15 is a cross-sectional view taken along line 15-15 in FIG. 12.
Figure 16:
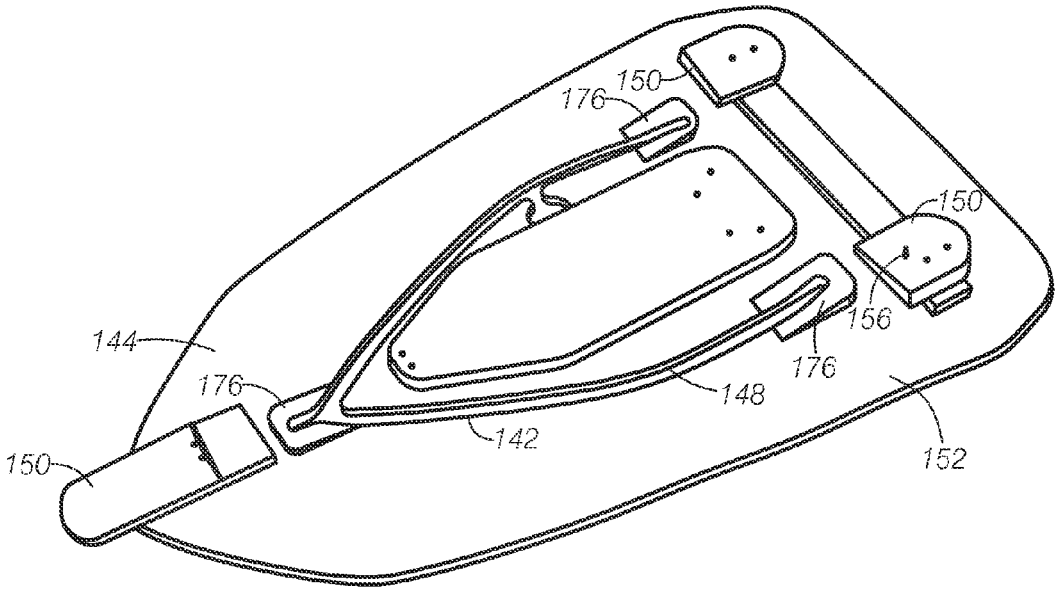
FIG. 16 is a bottom view of the mounting plate of FIG. 12.

Mounting plate 144 includes an elongated slot 148 configured to guide a distal end of a tether along the motion path, for example as illustrated in FIGS. 13 and 16, which may be a path similar to the wishbone track described above. Mounting plate 144 may further include parking zones with locking slots 174 and one or more friction surfaces providing frictional engagement in zones where platforms 162, 164 reposition, similar to the features described above in the first embodiment. Mounting plate 144 may also have tensioning features, such as a built-up of material 176.

Example dimensions of the embodiment shown in FIGS. 12-20 include a mounting plate 144 having a wishbone shaped slot 148 measuring about 19 inches lengthwise. Built-up material 176, in the form of ramps, may start at about an inch from the slot ends and reach full thickness about ¾ inch from slot ends and extend at least about ¼ inch beyond the ends of the slots.

Mounting plate 114 may be provided with one or more spacing elements 150 configured to be sandwiched between mounting plate 144 and windsurf board 130. Spacing element 150 is dimensioned to set a bottom surface 152 of mounting plate 144 apart from an upper surface 154 of gliding board 130 by keeping bottom surface 152 of mounting plate 144 raised above gliding board 130 so that a distal end of a tether slides uninhibited in slot 148 of mounting plate 144.

In some examples, mounting plate 114 may have a length of about 32 inches, a width of about 19 inches, and a thickness of about ⅜ inches. Mounting plate 114 may be provided with slot 148 having a width of about ⅝ inch, a length of about 19 inches from one end of the wishbone shape to the other end, and having open ends of the wishbone shaped slot 148 about 9 inches apart. Spacing element 150 may have a thickness of about ¾ inch at a center location of the gliding board and about 2 inches at the side edges of the gliding board. In some embodiments, spacing element 150 may have a length of about 15 inches. A tether may have a length of about 1¼ inch and a diameter of about 5/16 inch. These are exemplary dimensions only and may be adjusted by one skilled in the art.

The number and shape of spacing elements used to support the mounting plate may vary depending on the application. General considerations for determining the amount and dimensions of the spacing elements may include the amount of flexing the mounting plate endures due to rider's weight and forces endured, and the space provided between the mounting plate and the gliding board required for the platform hardware not to contact and damage the board surface. Mounting plate and spacing elements may each be made of any suitable material, for example wood, fiberglass, plastics, and the like.

Spacing elements 150 may be permanently secured to mounting plate 144 by conventional joining techniques such as mechanical fastening, adhesives, injection molding techniques, and the like, depending on the materials used. In other embodiments, spacing elements may be removably attached to a mounting plate. In some embodiments, additional support structures may be provided to assist in holding the mounting plate 144 in place. For example, foam may be sprayed in place between mounting plate 144 and gliding board 130 for added support.

In some embodiments, mounting plate 144 may be secured to windsurfing board 130 by fastening elements 156 interacting with pre-existing features of board 130. For example, fasteners fitting in existing foot strap slots 153 on gliding board 130 may secure mounting plate 144 to the board.

In other possible embodiments, customized platforms, for example platforms 162 and 164, may be interchangeable between different gilding boards, for example where a sailor owns more than one gliding board or borrows a gliding board. A customized platform may be more comfortable and may be configured for easy adjustment of stance, angle of feet relative to the board, or releasability features during crashes.

FIGS. 17-20 illustrate possible positions of platforms 162 and 164 on guide track 142 provided in mounting plate 144 while the windsurf board is traversing a supporting surface 136. Platforms 162 and 164 include foot receptacles 166 and 168. The position of a person's feet is illustrated with wetsuit booties 170 and 172.

Figure 17:
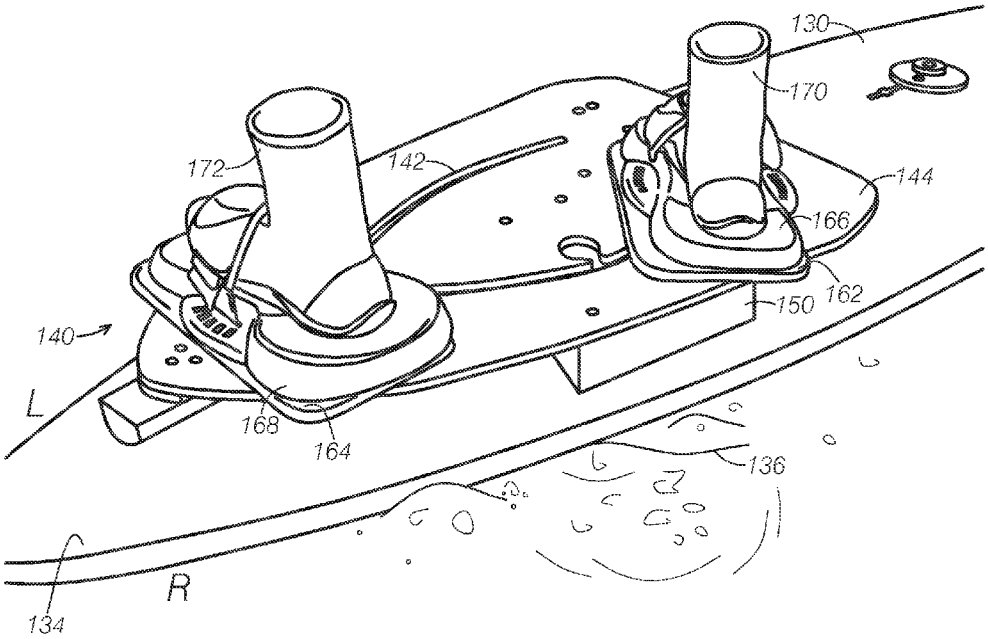
FIG. 17 is a perspective view of the mounting plate of FIG. 12 provided with two platforms in a starboard stance.

The motion path defined by guide track 142 has the shape of a wishbone. FIG. 17 illustrates a starboard stance, wherein platforms 162 and 164 are in parking positions at opposing ends of guide track 142 with the toes facing the left L side of windsurf board 130. When a person is standing in this position, with feet fully inserted in foot receptacles 166 and 168, restraining elements of platforms 162 and 164 are retracted.

Figure 18:
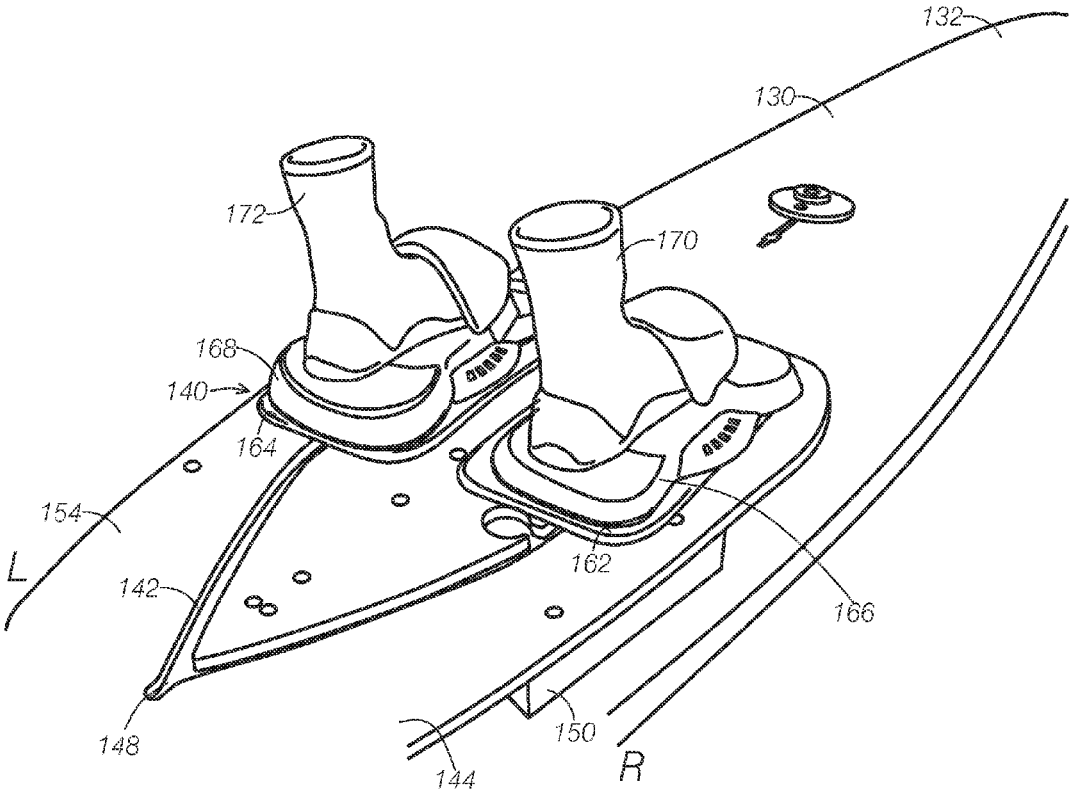
FIG. 18 is a perspective view of the configuration of FIG. 12 in a direct downwind stance.

FIG. 18 illustrates a position wherein platforms 162 and 164 are positioned generally parallel, both facing bow 132 of windsurf board 130. Platforms 162 and 164 are both positioned at the open ends facing of wishbone-shaped guide track 142.

Figure 19:
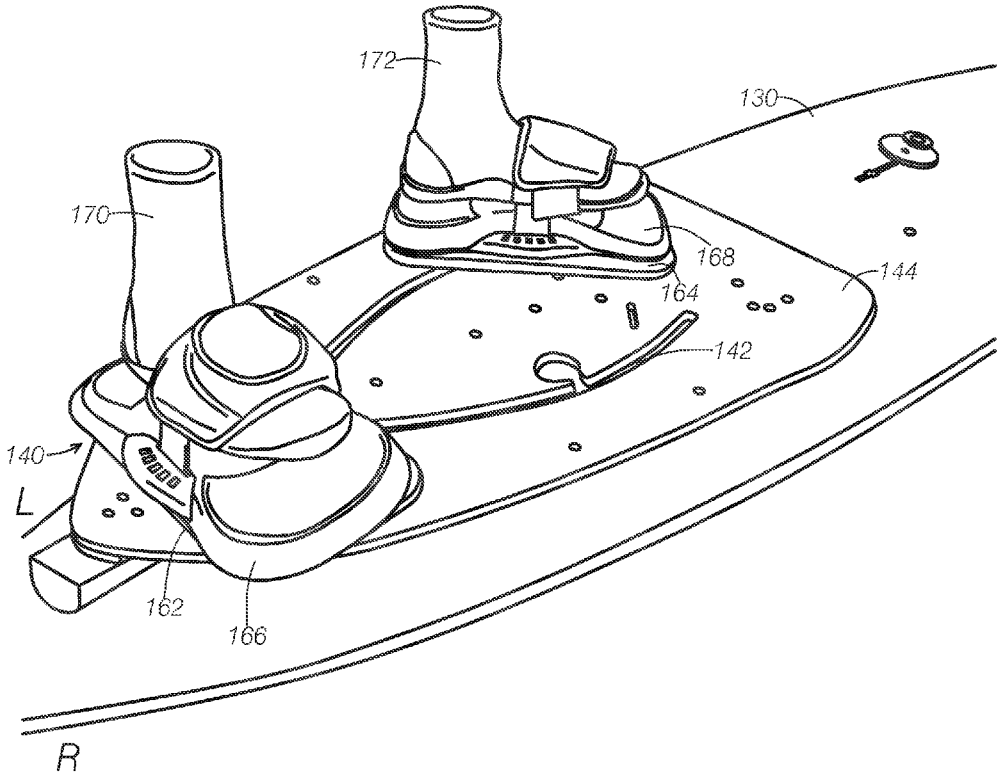
FIG. 19 is a perspective view of the configuration of FIG. 12 in a port stance.

FIG. 19 illustrates a port stance on windsurf board 130. In this position, both feet are facing towards the right side R of windsurf board 130. A right foot is positioned at the closed end of the wishbone-shaped guide track 142 towards stern 134 of windsurf board 130. A left foot is positioned at a bow facing end of a left arm of guide track 142.

Figure 20:
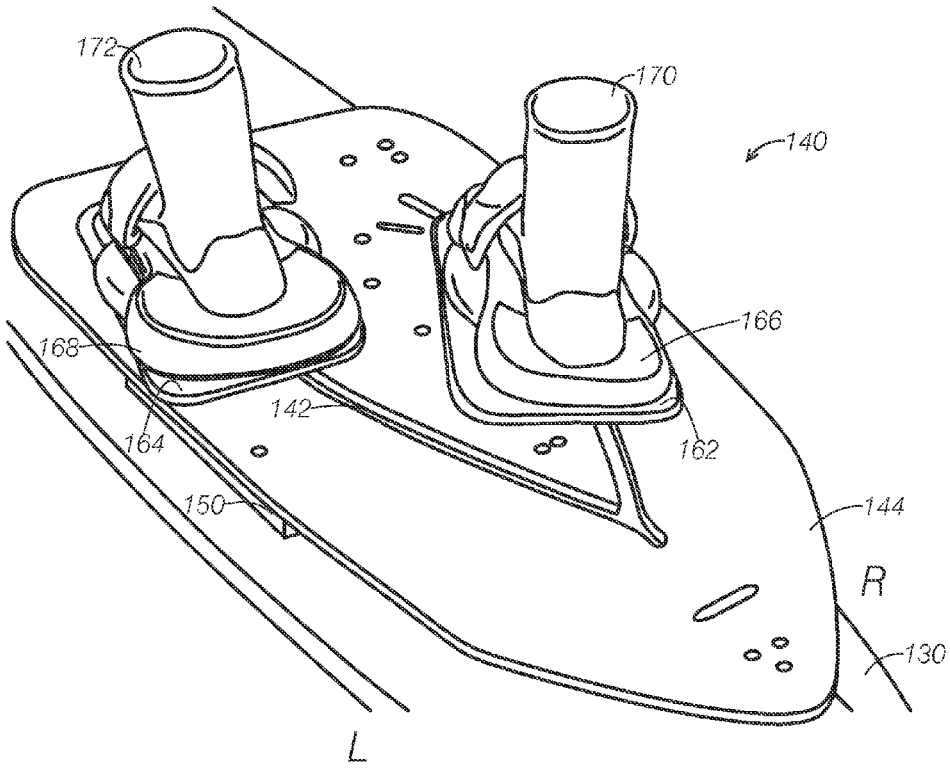
FIG. 20 is a perspective view of the configuration of FIG. 12 in a transition stance.

FIG. 20 illustrates a transition stance of platforms 162 and 164. The stance may be reached as a transition movement between stances or the sailor may hold this position for an extended time. In this position, platforms 162 and 164 are not in a parked position but slide freely along the track subject to forces applied by the sailor. The foot repositioning system may provide increased stability as a result of a combination of forces applied by the sailor and the design of the foot repositioning system.

A third embodiment of inventive subject matter is described as applied to a kite board. Kiteboarders commonly use a surfboard that is unidirectional and suffer from the same need to switch stance when completely changing direction relative to the wind. Known kiteboards have fixed foot straps that have been added to some boards to allow better connection with the board in rough water or surf, and while jumping.

Figure 24:
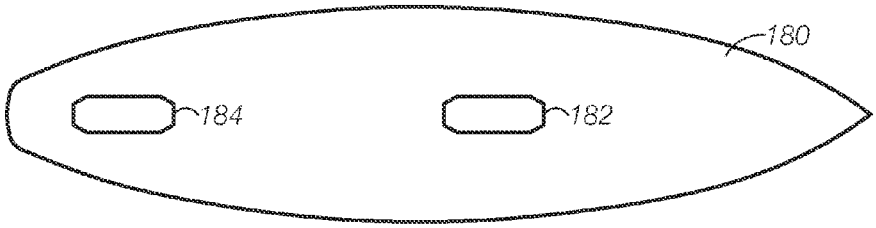
FIG.24 RELATED ART
FIG. 24 is a top view of a conventional unidirectional kiteboard.
Figure 25:
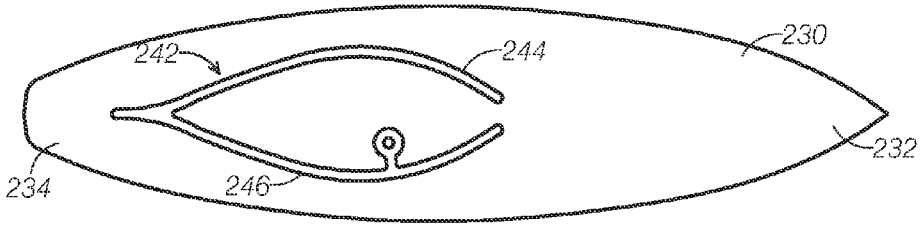
FIG. 25 is a top view of a unidirectional kiteboard provided with a guide track according to another embodiment of the inventive subject matter.

An example of a known kiteboard is shown in FIG. 24. Kiteboard 180 has fixed foot straps 182 and 184. Fixed straps 182, 184 are typically mounted along a center line of kiteboard 180. FIG. 25 shows a kiteboard 230 provided with a guide track 242 as may used in an example embodiment of the inventive subject matter. Kiteboard 230 has a bow 232 and a stern 234.

Guide track 242 has a lay-out extending from about a central location of kiteboard 230 towards stern 234 of kiteboard 230. Guide track 242 may define a motion path having a shape of a nearly closed wishbone, wherein the mid-board ends of the arms of the wishbone guide track 242 nearly touch. In another embodiment, the ends of the guide track may connect but the platform may be prevented from moving through.

Guide track 242 may include two arms 244 and 246 extending along kiteboard 230. Arms 244 and 246 meet at a location towards stern 234 of kiteboard 230 and arms 244, 246 extend towards a central location of kiteboard 230. In some embodiments, parking zones may be provided along guide track 242, for example at both open ends and at the closed end of wishbone shaped guide track 242, allowing a sailor to position his feet in positions corresponding approximately to location of the existing fixed straps.

Figure 21:
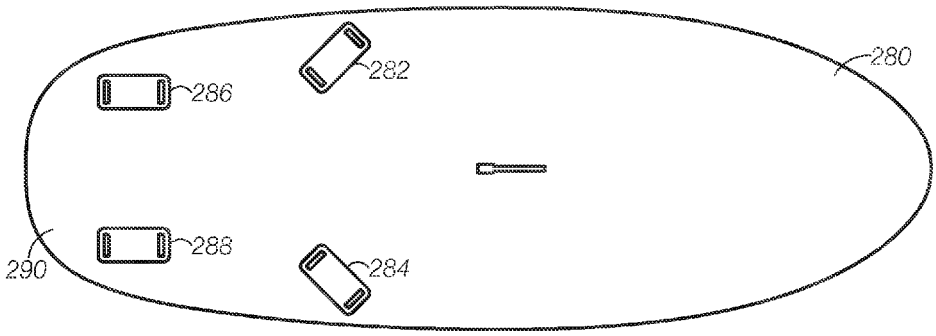
FIG.21 RELATED ART
FIG. 21 is a top view of a conventional wide board.
Figure 22:
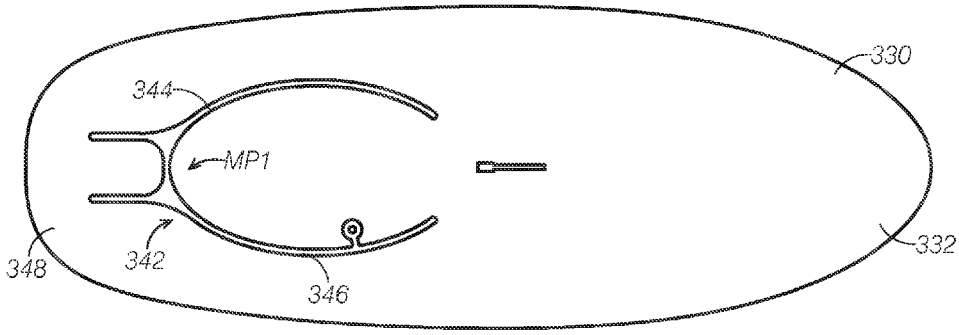
FIG. 22 is top view of a wide board provided with a guide track according to an example embodiment of the inventive subject matter.
Figure 23:
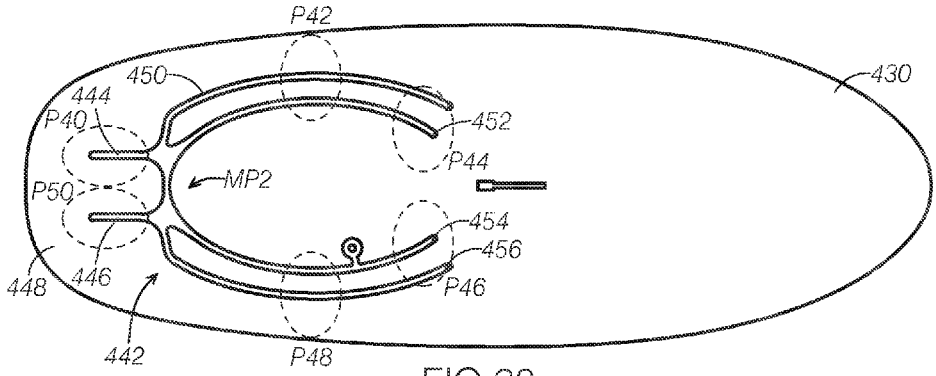
FIG. 23 is top view of a wide board provided with a guide track according to another example embodiment of the inventive subject matter.

Further possible embodiments of the inventive subject matter are shown in FIGS. 22 and 23. FIG. 21 shows a wide board 280, for example a windsurf board, as known in the art and having fixed foot straps. Foot straps 282 and 284 are positioned at about a mid-board location of wide board 280, and two foot straps 286 and 288 are positioned near the back of the board, towards stern 290 of wide board 280. Here too, a high level of skill is needed to step out of the straps and back in the straps on the opposite side of the board.

FIG. 22 shows an embodiment of a foot repositioning system including a guide track 342. Guide track 342 has a motion path including two arms 344 and 346 extending from a stern section 348 of wide board 330 generally parallel toward a meeting point MP1 where they connect, and each arm extending forward to the bow 332 from meeting point MP1 following a path curved outwards towards both sides respectively of wide board 330 and ending at about a mid-board location. Platforms interacting with guide track 342 may be parked at locations similar to the locations provided by fixed foot straps 282, 284, 286, and 288 on board 280 shown in FIG. 21.

Another example of a guide track on a wide board is shown in FIG. 23. In this embodiment, wide board 430 is provided with a guide track 442 having two generally parallel arms 444 and 446 at stern section 448 extending up to meeting point MP2 where they connect, and having four arms 450, 452, 454, and 456 curving forward from a meeting point MP2 toward a mid-board location. Several parking zones, for example parking zones P40, P42, P44, P46, P48, and P50 may be provided along guide track 442. In some embodiments, parking zones may include friction features only, for example to assist in holding a platform in place during temporary stances.

In further possible embodiments, riders may opt to adjust the platform locking release tension so that a relaxed foot is locked in and release of the platform is achieved by moving the foot or toes, for example by scrunching toes backward and/or pushing the foot tighter in the receptacle.

The inventive subject matter further contemplates methods for repositioning a user's feet on a gliding board. In some embodiments, repositioning may include positioning of the feet in foot receptacles on a platform, moving the feet toward a desired position along a predetermined guide track by applying force with a foot to the platform allowing the platform to slide freely along the guide track until the desired position is reached, holding the feet in the desired position by applying a tensioning force to the platform and the guide track, and repositioning the feet along the guide track by releasing tension to the platform and the guide track, and repositioning the platform to a different desired position along the guide track.

The inventive subject matter allows new stances while the feet remain attached to foot receptacles, for example by positioning the feet side by side so the rider can sail directly downwind, or a new sailing mode where a sailor can rapidly switch from side to side relative to a direct downwind direction to enjoy riding a wave or swell without extreme contortions of the body.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A foot repositioning system for a gliding board, comprising:

a platform having a top surface and a bottom surface, the platform including a foot receptacle disposed on the top surface of the platform, and a tether coupled to the platform with a distal end protruding from the bottom surface of the platform; and a guide track configured to slidably receive the distal end of the tether, the guide track defining a motion path over which the platform slides freely in response to forces applied by a user's foot while the gliding board is traversing a supporting surface.

2. The foot repositioning system of claim 1, wherein the distal end of the tether and the guide track are configured to prevent the platform from being released from the guide track while the gliding board is traversing a supporting surface.

3. The foot repositioning system of claim 1, wherein the tether comprises a tensioning element tensioning the distal end of the tether to a portion of the guide track until the user applies a counteracting force to the platform.

4. The foot repositioning system of claim 3, wherein the tensioning element comprises a spring element.

5. The foot repositioning system of claim 1, further comprising a mounting plate configured to be coupled to the gliding board and wherein the guide track is formed in the mounting plate.

6. The foot repositioning system of claim 5, wherein the mounting plate comprises one or more fastening elements allowing coupling of the mounting plate to pre-existing features of the gliding board.

7. The foot repositioning system of claim 5, wherein the mounting plate comprises a slot configured to guide the distal end of the tether along the motion path.

8. The foot repositioning system of claim 5, wherein the mounting plate comprises a spacing element configured to be sandwiched between the mounting plate and the gliding board and dimensioned to allow free movement of the platform along the motion path.

9. The foot repositioning system of claim 5, wherein the mounting plate comprises a friction surface providing friction to the bottom surface of the platform thereby restricting sliding movement of the platform along the guide track.

10. The foot repositioning system of claim 5, wherein the mounting plate comprises one or more parking zones allowing the user to secure the platform in a predetermined position and to release the platform from the predetermined position by applying a counteracting force to the platform while the gliding board is traversing a supporting surface.

11. The foot repositioning system of claim 10, further comprising a restraining element coupled to the platform and configured to interact with a complementary element of the gliding board to assist in holding the platform in place in the parking zone.

12. The foot repositioning system of claim 10, wherein the guide track and the tether are dimensioned to provide an interference fit in the parking zone.

13. A gliding board assembly comprising:

a gliding board for traversing a supporting surface while a user is riding the board;

a platform having a top surface and a bottom surface, the platform including a foot receptacle disposed on the top surface of the platform and a tether coupled to the platform with a distal end protruding from the bottom surface of the platform; and a guide track disposed on the gliding board and the guide track having an opening configured to slidably receive the distal end of the tether, the guide track defining a motion path over which the platform slides freely in response to forces applied by a user's foot while the gliding board is traversing a supporting surface.

14. The gliding board assembly of claim 13, wherein the guide track is an integrated part of the gliding board.

15. The gliding board assembly of claim 13, wherein the gliding board comprises a friction surface providing friction to the bottom surface of the platform thereby restricting sliding movement of the platform along the guide track.

16. The gliding board assembly of claim 13, wherein the bottom surface of the platform comprises a friction surface restricting sliding movement of the platform along the guide track upon application of force to the platform by a user.

17. The gliding board assembly of claim 13, wherein the gliding board has a bow at one end and a stern at the other end of the gliding board, and wherein the guide track is located closer to the stern than to the bow.

18. A method for repositioning a user's feet on a gliding board, the method comprising:

positioning the feet in foot receptacles on a platform;

moving the feet toward a desired position along a predetermined guide track by applying force with a foot to the platform allowing the platform to slide freely along the guide track until the desired position is reached;

holding the feet in the desired position by applying a tensioning force to the platform and the guide track;

repositioning the feet along the guide track by releasing tension to the platform and the guide track, and repositioning the platform to a different desired position along the guide track.

19. The method of claim 18, wherein the guide track is integrated with the gliding board.

20. The method of claim 18, wherein the guide track is provided on a mounting plate configured to be coupled to the gliding board.

* * * * *